US007966769B2

(12) United States Patent
Cope et al.

(10) Patent No.: US 7,966,769 B2
(45) Date of Patent: Jun. 28, 2011

(54) APPARATUS AND METHOD TO PACKAGE ARTICLES FOR STORAGE AND IDENTIFICATION

(75) Inventors: Jason Cope, Ankeny, IA (US); David Kurth, Grimes, IA (US)

(73) Assignee: Pioneer Hi-Bred International, Inc., Johnston, IA (US)

( * ) Notice: Subject to any disclaimer, the term of this patent is extended or adjusted under 35 U.S.C. 154(b) by 100 days.

(21) Appl. No.: 12/235,100

(22) Filed: Sep. 22, 2008

(65) Prior Publication Data

US 2009/0077932 A1 Mar. 26, 2009

Related U.S. Application Data

(60) Provisional application No. 60/975,389, filed on Sep. 26, 2007.

(51) Int. Cl.
*A01C 1/00* (2006.01)

(52) U.S. Cl. ..... 47/87

(58) Field of Classification Search ..... 47/14; 206/531
See application file for complete search history.

(56) References Cited

U.S. PATENT DOCUMENTS

| | | | | |
|---|---|---|---|---|
| 1,007,050 | A * | 10/1911 | Bascom | 47/14 |
| 2,317,860 | A | 4/1943 | Sorensen | |
| 3,387,699 | A | 6/1968 | Heller | |
| 3,472,367 | A | 10/1969 | Hellstrom | |
| 3,494,322 | A | 2/1970 | Dubbels | |
| 3,840,114 | A | 10/1974 | Sama | |
| 4,011,949 | A | 3/1977 | Braber et al. | |
| RE29,705 | E | 7/1978 | Compere | |
| 4,158,411 | A | 6/1979 | Hall et al. | |
| 4,168,002 | A | 9/1979 | Crosby | |
| 4,211,326 | A | 7/1980 | Hein et al. | |
| 4,231,477 | A | 11/1980 | De Felice | |
| 4,295,567 | A | 10/1981 | Knudsen | |
| 4,305,502 | A | 12/1981 | Gregory et al. | |
| 4,384,649 | A | 5/1983 | Brodsky | |
| 4,534,468 | A | 8/1985 | Nuckols et al. | |
| 4,574,954 | A | 3/1986 | Reid | |

(Continued)

FOREIGN PATENT DOCUMENTS

EP 1 657 184 A1 5/2006

(Continued)

OTHER PUBLICATIONS

International Search Report from corresponding International Patent Appl. No. PCT/US2008/077204, mailed Feb. 19, 2009.

(Continued)

*Primary Examiner* — Francis T Palo
(74) *Attorney, Agent, or Firm* — Alston & Bird LLP

(57) ABSTRACT

A method and apparatus for containing, protecting, isolating, and individually identifying sets of one or more articles in a plurality of compartments such that information related to the sets can be easily and efficiently linked to the set. In an example of the apparatus, the apparatus has a compartment layer, a sealant layer, and indicia which may individually identify compartments. In another example, a method includes taking a compartment layer and sealant layer, loading compartments with sets of one or more articles, closing the compartment layer with the sealant layer, and identifying each compartment for each seed or portion thereof with a positionally-addressable ordered array of indicia on at least one of the layers of the package.

10 Claims, 10 Drawing Sheets

U.S. PATENT DOCUMENTS

| | | | | |
|---|---|---|---|---|
| 4,664,262 | A * | 5/1987 | White | 206/531 |
| 4,673,086 | A | 6/1987 | Braverman et al. | |
| 4,736,849 | A | 4/1988 | Leonard et al. | |
| 4,762,230 | A | 8/1988 | Croce | |
| 4,815,606 | A | 3/1989 | Airola | |
| 4,844,246 | A | 7/1989 | Harrison et al. | |
| 4,911,291 | A | 3/1990 | Iwata et al. | |
| 4,911,304 | A | 3/1990 | Bunin | |
| 4,988,004 | A | 1/1991 | Intini | |
| 5,014,851 | A | 5/1991 | Wick | |
| 5,082,113 | A | 1/1992 | Romick | |
| 5,088,603 | A | 2/1992 | Kirkpatrick | |
| 5,203,455 | A | 4/1993 | Hewelt et al. | |
| 5,242,055 | A | 9/1993 | Pora | |
| 5,265,728 | A | 11/1993 | Allendorf et al. | |
| 5,331,907 | A | 7/1994 | Beaujot | |
| 5,358,118 | A | 10/1994 | Thompson et al. | |
| 5,549,204 | A | 8/1996 | Toren | |
| 5,560,490 | A | 10/1996 | Chawla | |
| RE35,445 | E | 2/1997 | Pora | |
| 5,624,036 | A | 4/1997 | Roulin et al. | |
| 5,695,063 | A | 12/1997 | Roulin et al. | |
| 5,727,687 | A | 3/1998 | Renner | |
| 5,791,478 | A | 8/1998 | Kalvelage et al. | |
| 5,904,249 | A | 5/1999 | Roulin et al. | |
| 5,927,500 | A | 7/1999 | Godfrey et al. | |
| 5,954,204 | A | 9/1999 | Grabowski | |
| 6,155,423 | A | 12/2000 | Katzner et al. | |
| 6,253,920 | B1 | 7/2001 | Kallgren | |
| 6,345,717 | B1 | 2/2002 | Flewitt | |
| 6,474,500 | B1 | 11/2002 | Carr et al. | |
| 6,516,949 | B2 | 2/2003 | Fuller et al. | |
| 6,637,596 | B1 | 10/2003 | Ito et al. | |
| 6,776,285 | B2 | 8/2004 | Shibata | |
| 6,776,288 | B2 | 8/2004 | Kopecky | |
| 6,945,017 | B1 | 9/2005 | Bonney et al. | |
| 7,121,410 | B2 | 10/2006 | Rohrmus et al. | |
| 2003/0204992 | A1 | 11/2003 | Poret et al. | |
| 2009/0077932 | A1 * | 3/2009 | Cope et al. | 53/473 |

FOREIGN PATENT DOCUMENTS

| | | | |
|---|---|---|---|
| GB | 1 396 224 | A | 6/1975 |
| WO | WO 83/03518 | | 10/1983 |
| WO | WO8303518 | * | 10/1983 |
| WO | 87/03167 | A1 | 6/1987 |
| WO | 01/47346 | A1 | 7/2001 |
| WO | WO-03/015496 | A2 | 2/2003 |

OTHER PUBLICATIONS

Written Opinion from corresponding International Patent Appl. No. PCT/US2008/077204, mailed Feb. 19, 2009.

* cited by examiner

APPARATUS AND METHOD TO PACKAGE ARTICLES FOR STORAGE AND IDENTIFICATION

CROSS-REFERENCE TO RELATED APPLICATIONS

This application claims priority under 35 U.S.C. §119(e) of a provisional application Ser. No. 60/975,389 filed Sep. 26, 2007, which application is hereby incorporated by reference in its entirety.

FIELD OF THE INVENTION

The present invention relates generally to a method and apparatus for packaging articles for the purposes of storage, identification, retrieval, and/or discharge. More particularly, the present invention provides a method and apparatus for packaging a plurality of seeds such that the seeds are protected, contained, preserved, individually identifiable, and may be efficiently and easily linked or correlated with information corresponding to the seeds for retrieval and/or discharge.

BACKGROUND OF THE INVENTION

There are a wide variety of applications where articles need to be stored, where the articles can be protected and preserved, and at sometime later be easily, efficiently, accurately identified and/or possibly individually selected/retrieved/discharged for utilization. In many instances these articles have requirements for storage in order to ensure their protection from decay, contamination, or damage. These articles may have accompanying information that correlate them to information or data external to the storage device or apparatus in which they are stored. Whether these articles of storage are configured and controlled in sets, groups or families, it is often purposeful and useful to catalog and store them such that the accompanying information can be easily, efficiently and accurately linked to them individually or collectively.

A notable example of a type of these applications can be found in research and development. For instance, a sample may be taken from an article with the remainder being preserved, contained, or relegated to storage. This sample may be tested and information may be acquired from the sample. It is then necessary to be able to easily, efficiently and accurately link that information with the article to which it corresponds. One example of this type of tracking and storage used in research and development is plant research. Plant researchers often group material, for example seeds, into specific groups. In the case of seeds, samples of the seeds (e.g., a portion or chip from the seed or otherwise, seed chip) may be removed for testing, while the remaining, viable portion of the seed is placed into individual storage where it may be protected against degradation or harm to maintain its viability. Information learned from the seed samples or chips may indicate if the remaining, viable portion of a particular seed will have the desired qualities or genetics. The remaining, viable portion of each desired seed must then be accurately identified and recovered from storage in order to plant or make use of the seed.

A need has therefore been identified in the art for a more efficient way of storing, preserving, tracking, cataloging, identifying, selecting, retrieving, and recovering articles, such as seed.

BRIEF SUMMARY OF THE INVENTION

Methods, apparatuses, and kits to contain, protect, and individually identify one or more stored articles, such as seeds, so that information related to the articles can be easily and efficiently referenced, tracked and/or correlated to another set of articles having a relation to the stored articles is provided. The apparatus includes a compartment layer, a sealant layer, and indicia which individually identify each storage compartment and article.

Methods include recording, tracking, and correlating an article with its corresponding indicia so that the contents of each particular compartment may be easily, accurately and efficiently identified.

Kits for storing, uniquely identifying and cataloging seeds are provided. The kit may include a first layer having a plurality of compartments adapted to open toward a first surface of the first layer, a second layer adapted to affix to the first surface in covering relation to the plurality of compartments, and a positionally-addressable ordered array of indicia on at least one of the layers to identify and cataloging each specific compartment.

DETAILED DESCRIPTION

Figure 1A:
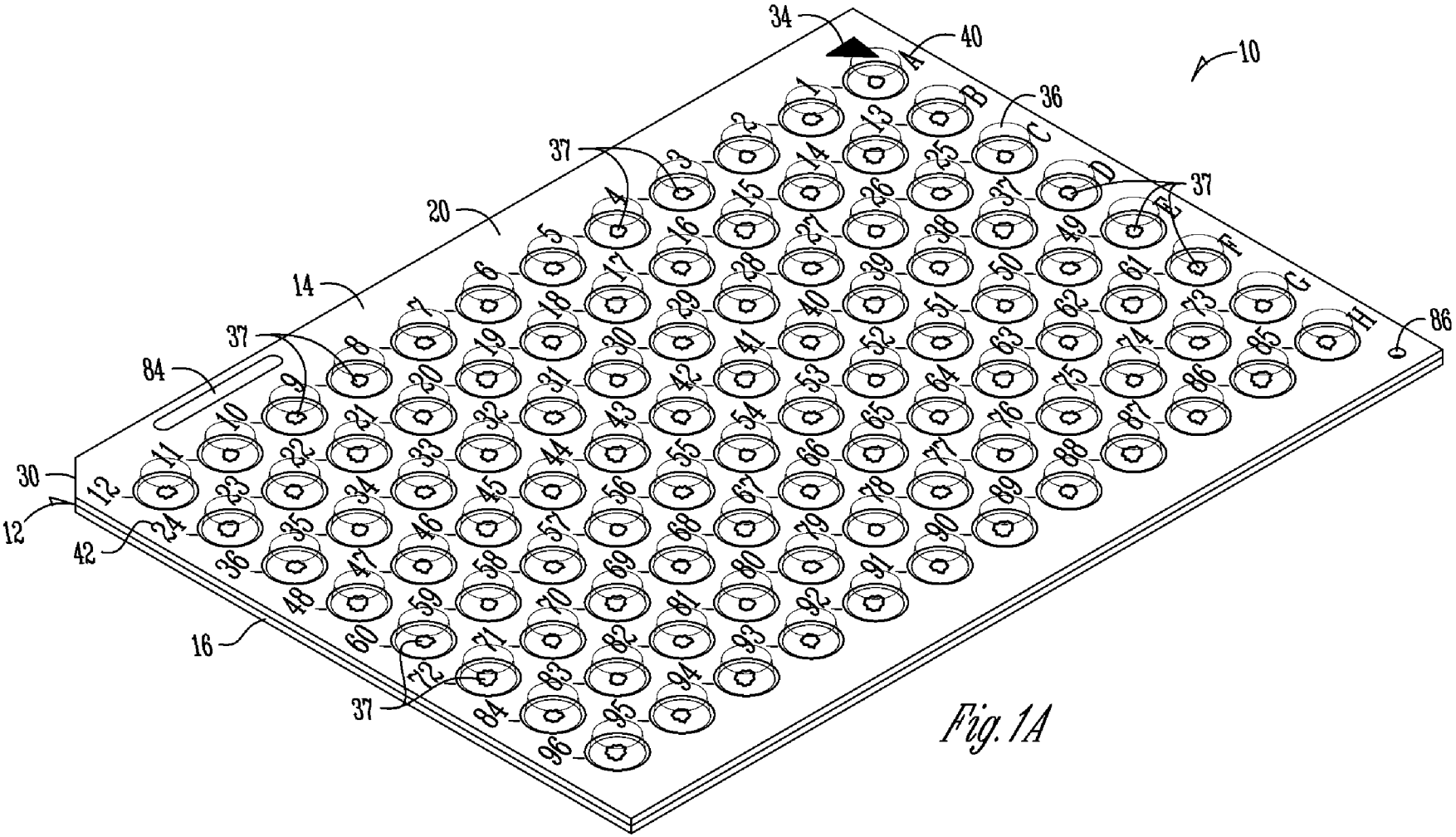
FIG. 1A is an isometric view of the apparatus according to an exemplary embodiment of the present invention.

The following description is merely exemplary in nature and is not intended to limit the present disclosure, application, or uses.

For a better understanding of the invention, several exemplary embodiments will now be described in detail. Reference will be taken from time-to-time to the appended drawings. Reference numerals will be used to indicate certain parts or locations in the drawings. The same reference numerals will indicate the same parts or locations throughout the drawings unless otherwise indicated.

Apparatus

Figure 1B:
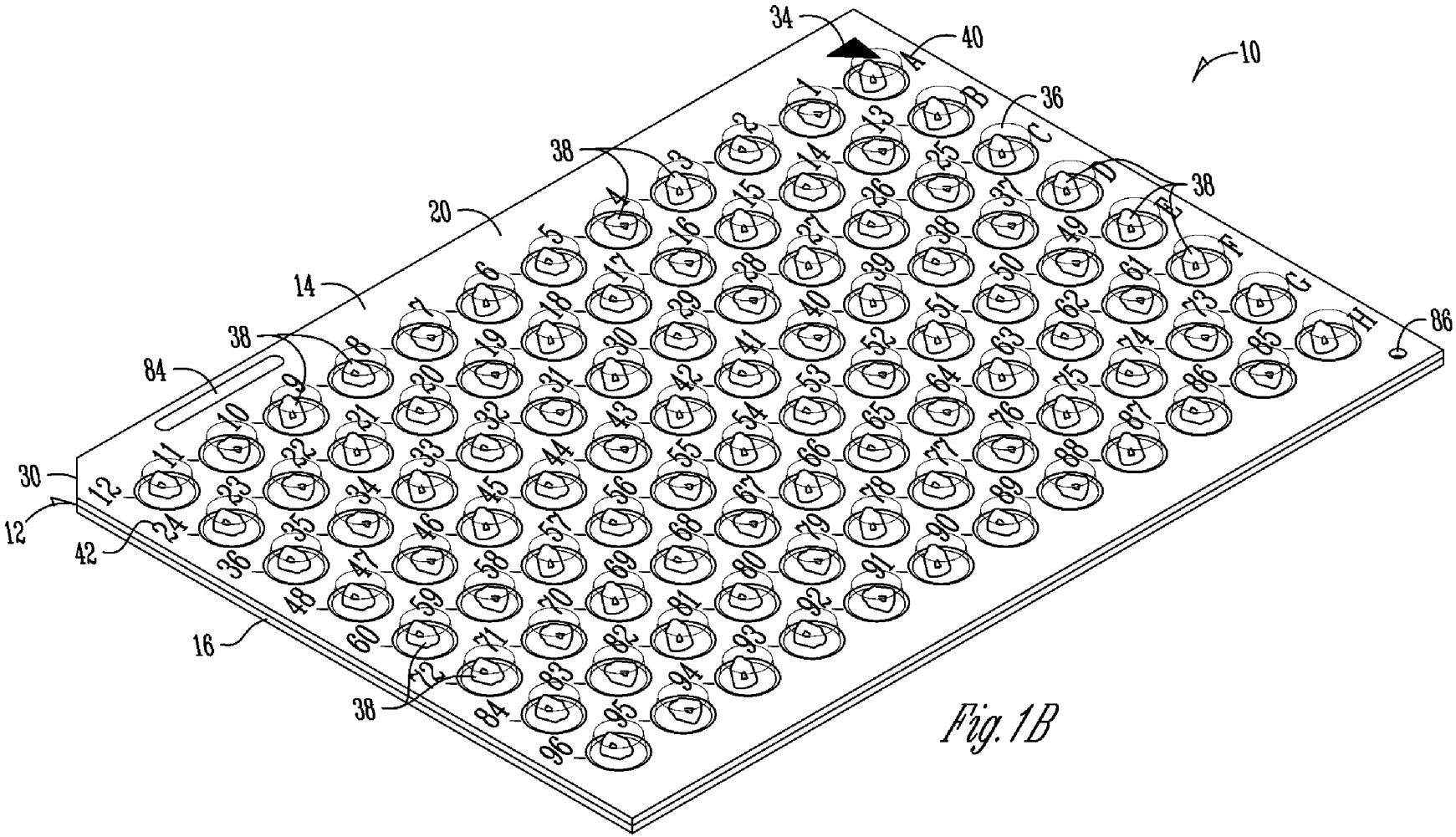
FIG. 1B is an isometric view of the apparatus according to another exemplary embodiment of the present invention.

FIGS. 1A and 1B illustrate one aspect of an assembled view of the apparatus 10 of the present invention. The apparatus 10 has a compartment layer 56, a sealant layer 50, indicia 34, 40, 42, 84 and may optionally include an outer layer 12 which may cover one or more surfaces of the compartment layer 56 and/or sealant layer 50, or any additional layer. One or more of these layers, and any other layer, may have indicia, labels, indicators or other signs and features, which may be included as a label and/or printed, embossed, stamped onto either the inner and/or outer surfaces of one or more of the layers. For example, one or more of the layers may include a barcode for scanning, tracking, cataloguing and/or retrieving data associated with articles or seeds housed in the compartment layer 56.

Figure 2A:
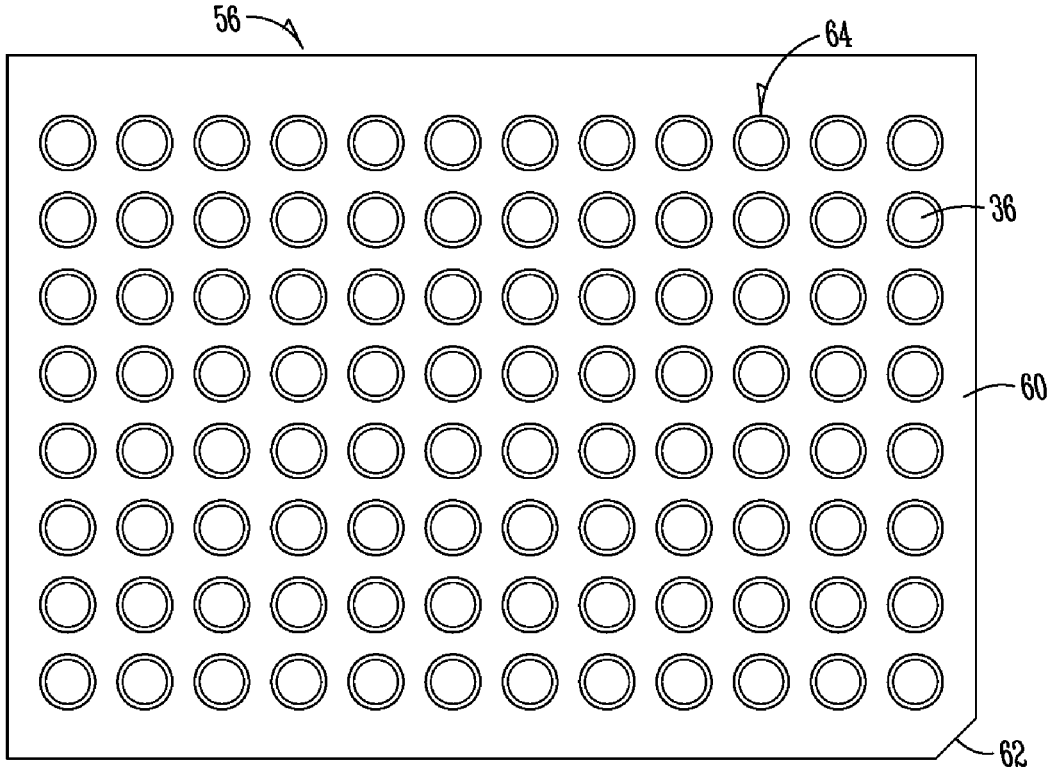
FIG. 2A is a plan view showing an outer surface of a compartment layer of the apparatus according to an exemplary embodiment of the present invention.
Figure 2B:
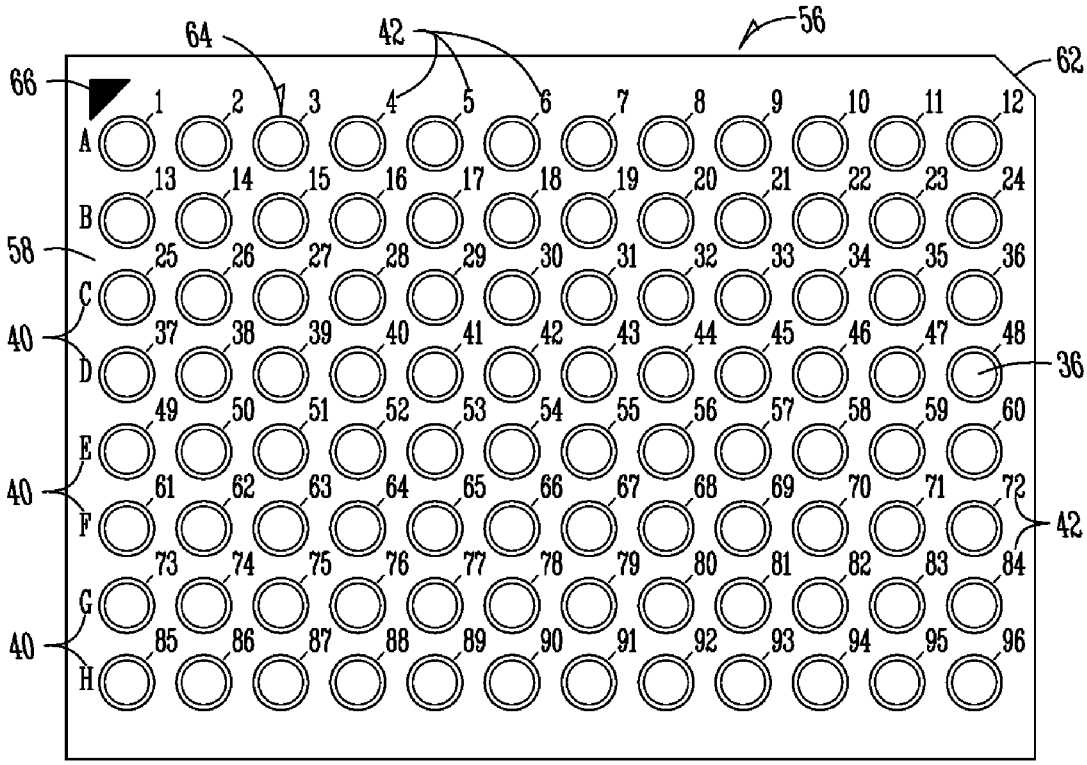
FIG. 2B is a plan view showing an inner surface of a compartment layer of the apparatus according to an exemplary embodiment of the present invention.
Figure 2C:
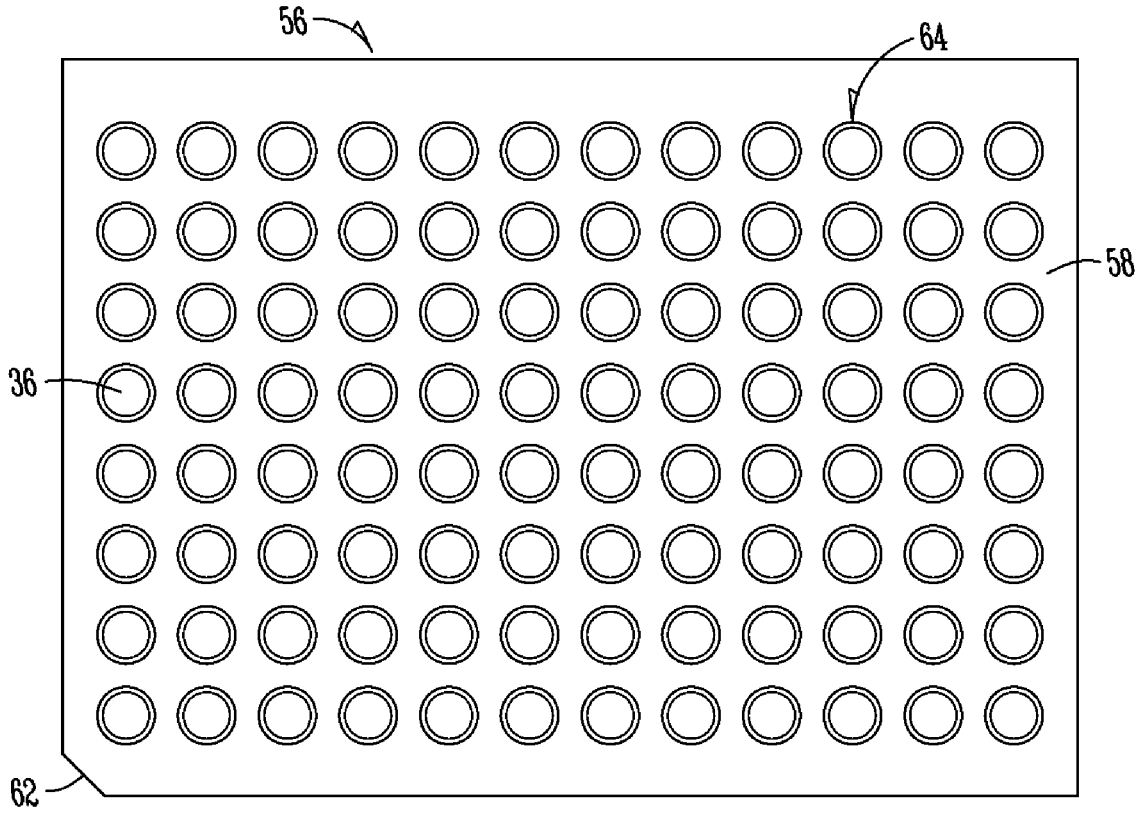
FIG. 2C is a plan view showing another embodiment of the compartment layer of the apparatus shown in FIGS. 2A and 2B.

FIGS. 2A, 2B and 2C illustrate inner 58 and outer 60 surfaces of one possible compartment layer 56. The compartment layer 56 has a plurality of compartments 36 which open toward the inner surface 58, and extend away from the outer surface 60. The plurality of compartments 36 form an ordered array 64 of compartments 36 having a particular pattern or arrangement of each compartment 36. The ordered array 64 of compartments 36 may be selected and arranged for a variety of reasons which could prove advantageous, including facilitating more efficient and accurate identification of articles 37 and seeds 38 in each unique compartment 36. The compartment layer 56 may include indicia or not as shown in FIG. 2C.

The compartment layer 56 may be made of a rigid, semi-rigid, or non-rigid material, which is optionally at least partially transparent. For example, various plastics may be suitable materials for the compartment layer 56, such as thermoplastics, including but not limited to, acrylonitrile, butadiene styrene (ABS), acrylic, polyvinyl chloride(s) (PVC) with our without plasticizers such as phthalates, polyethylene, polystyrene as well as many commercially available and possibly trademarked materials for purchase from Professional Plastics, 1810 E. Valencia Drive, Fullerton, Calif., 92831.

The compartment layer 56 may include an adhesive, such as a heat activated adhesive, on portions of one or more of its surfaces to facilitate assembly of the apparatus 10. Heat activated adhesives may also be replaced with non-heat activated adhesives or other binding agents or materials such as clips, pins, staples, rivets, brads, tape, cellophane, shrink wraps, wax, or other materials or combinations thereof. The compartment layer 56 may also have physical characteristics, such as markings or material alterations which may aid in identifying portions and/or the desired orientation of the compartment layer 56, for example one or more beveled corners 62 and/or small apertures, which may identify a specific corner of the compartment layer 56 for orientation purposes. Although the compartment layer 56, including other layers, are shown with a beveled or notched corner, it should be appreciated that one or more, or even none of the corners may be notched or beveled.

The compartment layer 56 may also have various indicia, such as for example a positionally-addressable ordered array of indicia, displayed on one or more of its surfaces for a variety of purposes, including, identifying compartments, rows, columns, or specific portions of the compartment layer 56. In one example of a compartment layer 56, as displayed in FIGS. 2A and 2B, the inner surface 58 of the compartment layer 56 has row indicia 40 identifying the rows, compartment identifying indicia 42, and orientation indicia in the form of an orientation arrow 66. The outer surface 60 may also have these, or other, types of indicia to provide positionally-addressable locations on the compartment layer 56. Indicia on the compartment layer 56 could be beneficial in cases where the compartment layer 56 is used separate from one or more of the other layers. The compartment layer 56 may also be void of the various indicia displayer in FIGS. 2A and 2B, as shown in FIG. 2C. Although the plurality of compartments 36 in the compartment layer 56 are shown in a row/column configuration, other compartment layer 56 configurations are contemplated herein, including, but not limited to, circular and/or spiral arrangements of the compartments 36. The plurality of compartments 36 could also be positioned in staggered rows and/or columns (e.g., similar to a honeycomb configuration). The plurality of compartments 36 could also take on different row-column arrangements/configurations to accommodate and/or facilitate uses other than storage and retrieval. For example, the plurality of compartments 36 could be in an arrangement (e.g., 4×20 or 2×25 design) that fits a seed planter and/or plot arrangements using range, row, and/or plot identifiers. According to one aspect of the present invention, the plurality of compartments 36 could have an organized arrangement defined by straight rows and straight columns. For example, the plurality of compartments 36 could be a layer of blister cells having an organized arrangement of 8 rows and 12 columns to form 96 blister cells.

The configuration of the plurality of compartments 36 can also be in an arrangement to facilitate storage, shipping, or the like of one or more layers or the assembly 10. It is also contemplated that the arrangement of the plurality of compartments 36 can imitate or be patterned according to the arrangement of compartments of any other piece of equipment that may dispense articles 37 and/or seeds 38 into the compartment layer 56 and/or retrieve articles 37 and/or seeds 38 from the compartment layer 56. Although the configuration of the plurality of compartments 36 may impart shape features to the assembly 10, it should be appreciated that the overall dimension(s) of the assembly 10 may be fashioned independent of the arrangement of the plurality of compartments 36.

FIGS. 1A and 1B show an article 37 and a seed 38 in the plurality of compartments 36, respectively. The article 37 and seed 38 may be any item suitable for storage, identification, retrieval, and/or discharge. The article 37 and seed 38 may also include any item to be protected, contained, preserved, individually identifiable, and/or linked or correlated with information corresponding to the seeds for retrieval and/or discharge. The article 37 and seed 38 also include samples from seeds, plant tissue samples, such as a leaf punch or otherwise. Other materials may also be included in each compartment 36 with article 37 and seed 38. For example, additional materials could include liquid or dry treatments, fungicides, nutrient, herbicides, growth promoters, and the like. These materials could be introduced (dispensed measurement of weight/weight or volume/weight) into the plurality of compartments 36.

The compartment layer 56 should not be construed as being limited to storage and identified retrieval of articles 37 and seed 38. The compartment layer 56, alone or in combination with one or more layers, such as the sealant layer 50, has numerous other possible applications. For example, the compartment layer 56 may be used for spectroscopic analysis, such as non-destructive detection of specific traits or properties associated with the article 37 or seed 38. Liquids, and/or dry reagents, may be added to one or more of the compartments 36 to perform specific laboratory assays, such as DNA extraction, protein assays, and seed/article soaks in materials ranging from lipids and carbohydrates to metabolites and small molecules. The compartment layer 56 could also serve as a growth matrix plate. In one aspect, treatments, as previously mentioned, could be added to each compartment 36. The compartment layer 56 could also be planted or covered with soil (unsealed or sealed with a degradable or dissolvable layer) for growth of plants from each compartment 36 in the compartment layer 56. Seeds 38 could be planted in the field and/or greenhouse directly from the compartment layer 56 (either alone or with one or more other layers). Seeds 38 and/or the compartment layer 56 could be re-arrayed as needed to establish a desired planting configuration, orientation, array and/or order. Additionally, the sealant layer 56 could be configured to absorb water to feed the seed 38 and further dissolve over time to allow the seed to grow if planted or greenhoused. Other aqueous solutions, such as chemical solutions, could chemically erode one or more of the layers to expose the seed 38. Generally speaking, the sealant layer 50 is adapted to affix to the compartment layer 56 in covering relation to the plurality of compartments 36 to seal the articles within each compartment 36 of the compartment layer 56. Therefore, in one exemplary aspect of the present invention, the package for storing, uniquely identifying and cataloging contents (such as an article 37 or seed 38) may include a first layer (such as a compartment layer 56) having a plurality of compartments 36 adapted to open toward a first surface (such as inner surface 58) of compartment layer 56. The package may also include a second layer (such as sealant layer 50) adapted to affix to compartment layer 56 in covering relation to the plurality of compartments 36. Additionally, the package may also include positionally-addressable ordered array of indicia (such as row indicia 40 identifying the rows, compartment identifying indicia 42, and orientation indicia in the form of an orientation arrow 66) on at least one of the layers to identify and catalogue each specific compartment.

The degree of closure may vary depending on the storage requirements of the content being stored. The sealant layer 50 could close off each compartment 36 such that articles contained in each compartment 36 are partially confined, or fully confined such that one or more of a range of contaminants are closed off from ingressing one or more of the compartments 36. Contaminants could include, air, water, light, radiation, insects, fungus, protozoa, monera, gasses, viruses, elements, compounds, or any other contaminant deemed harmful to the contents of the compartments 36. Alternative materials for the sealant layer 50 may include, but are not limited to, such materials as plastics (cellophane, saran wraps, plastic materials used for compartment layer 56), foils, paper(s) (non-mechanical penetration layer(s) being coated or uncoated), non-woven fiber (such as Tyvec), dissolvable layer(s) (dissolved with aqueous, organic, other materials, or any combinations or serial treatments thereof), bio-plastics, and/or starch and starch-based material. Other materials may also be used as a sealant layer 50, such as gels (gelatin, acrylamide, and agarose—which may perform the same function as a layer, but may also provide additional functions, and in certain examples may be described as a plug or occluder), and wax (such as a paraffin wax).

Figure 3A:
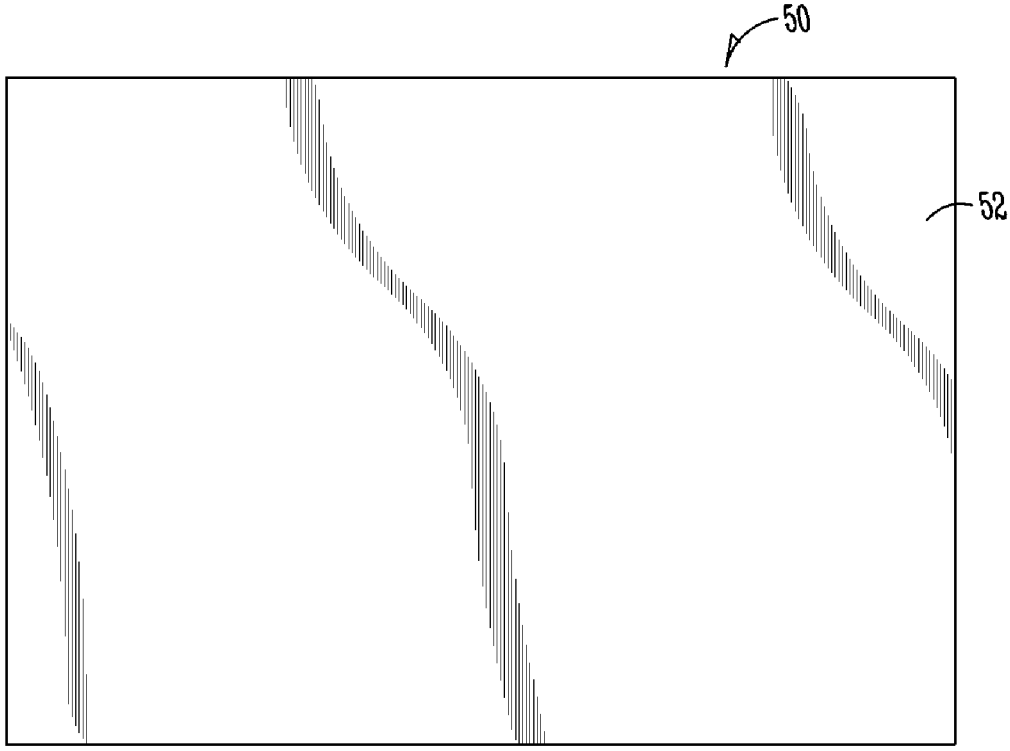
FIG. 3A is a plan view showing one side of a rupturable membrane of the apparatus according to an exemplary embodiment of the present invention.
Figure 3B:
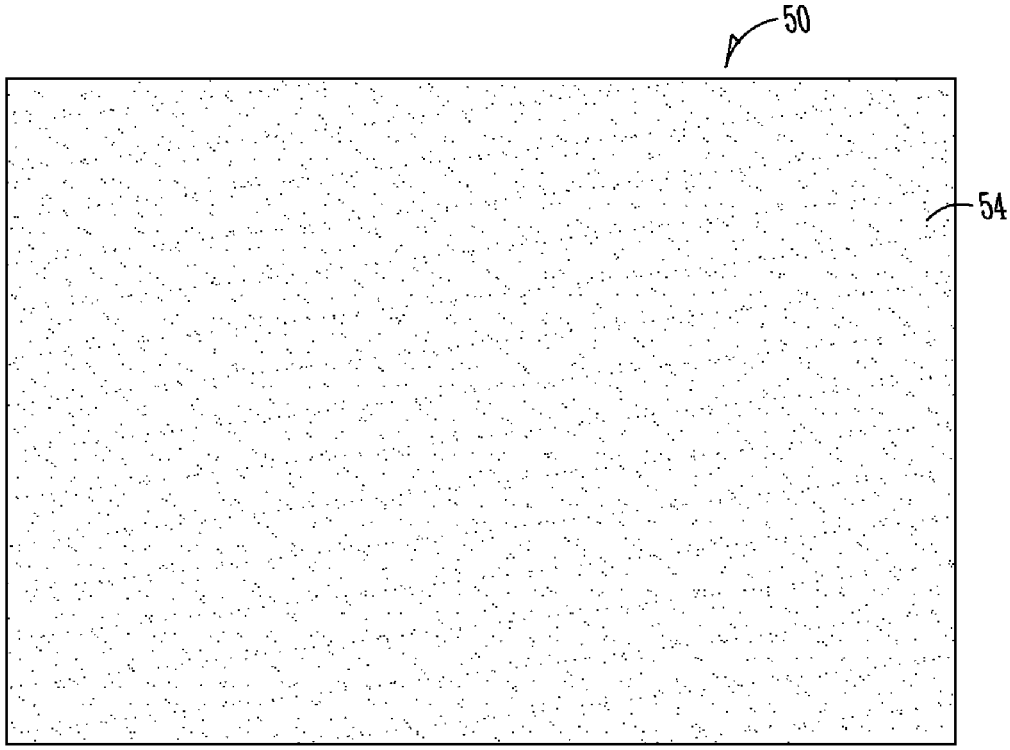
FIG. 3B is a plan view showing a sealant side of a rupturable membrane of the apparatus according to an exemplary embodiment of the present invention.

The sealant layer 50 may be a frangible material/layer. For example, the sealant layer 50 may be a frangible metal composition, such as aluminum foil, a frangible paper composition, or a frangible plastic composition whereby the sealant layer 50 may be ruptureable at a finger's pressure. The sealant layer 50 may be a ruptureable membrane made of materials suitable for being partially or wholly perforated for ease of access, retrieval, discharge of the material within the plurality of compartments 36. The sealant layer 50 may optionally include or have applied to it one or more additional layers of the same or different type of material from the sealant layer 50. Further, the sealant layer 50 may be adapted to rupture without the seed 38 or article 37 puncturing/piercing the sealant layer 50. For example, the sealant layer 50 may rupture from pressure being exerted on the sealant layer 50 as the compartment 36 is collapsed. The sealant layer 50 may contain an adhesive. For example, a heat activated adhesive may be incorporated into, or added to, one or more surfaces in order to facilitate closing the compartments 36 or assembling the apparatus 10 by binding the sealant layer 50 to one or more other layers. Portions of the sealant layer 50 with adhesive may have characteristics, such as lower reflectivity, which help identify the portions with adhesive. An example of a sealant layer is illustrated in FIGS. 3A and 3B. In this example, a first side 52 of the sealant layer 50 may not contain adhesive and is reflective, while a second side 54 may contain an adhesive and may appear less reflective than the first side 52. The sealant layer 50 may also be a cold-seal, such as a peel and stick cold seal. Examples of cold seal include peel and stick cold seal medication cards available at either Drug Packaging Inc. (901 Drug Package Lane, O'Fallon, Mo. 63366) or Total Pharmacy Supply (3400 Avenue E East, Arlington, Tex. 76011).

Figure 4A:
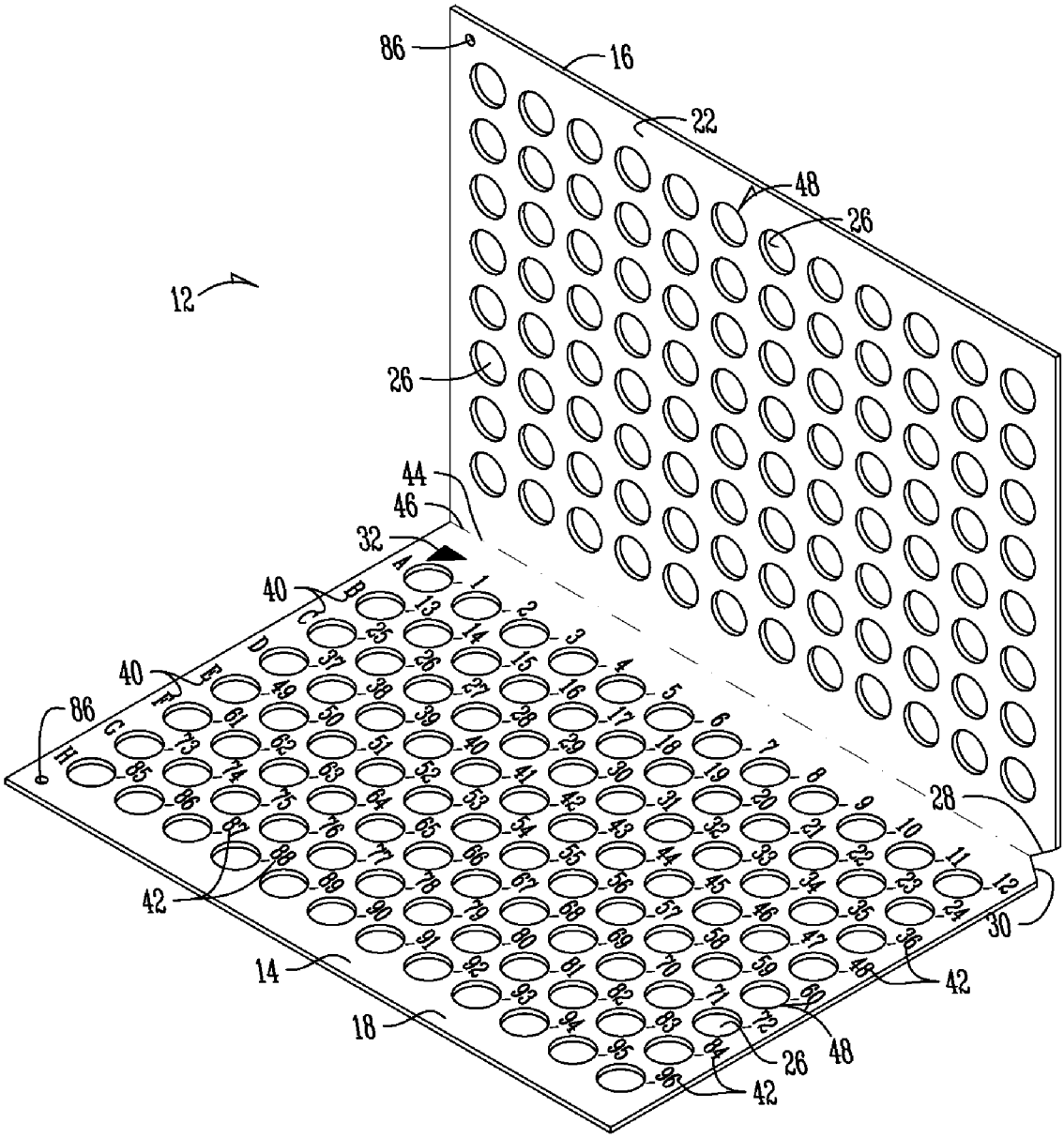
FIG. 4A is an isometric view showing inner surfaces of an outer layer of the apparatus according to an exemplary embodiment of the present invention.
Figure 4B:
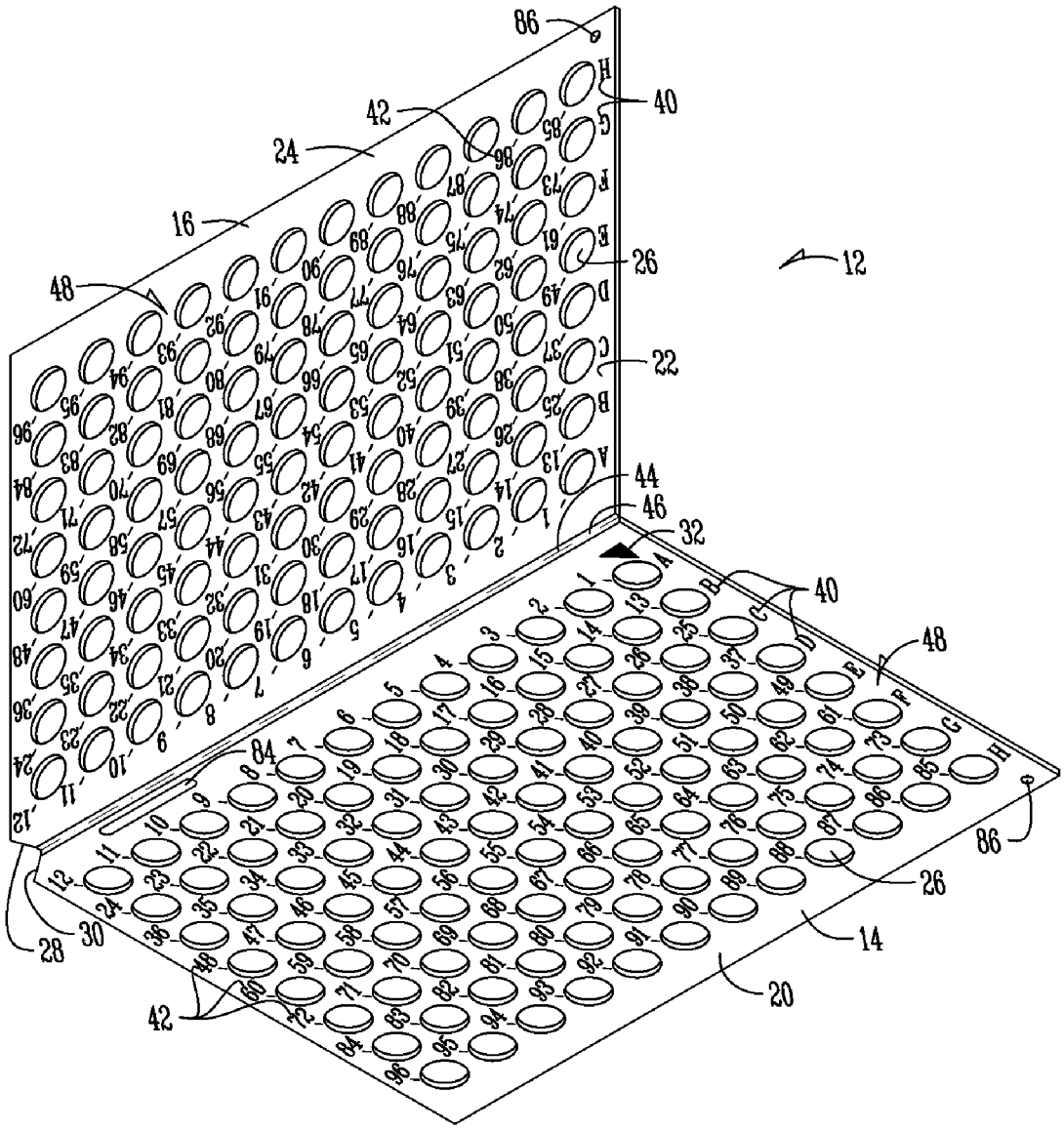
FIG. 4B is another isometric view showing outer surfaces of an outer layer of the apparatus according to an exemplary embodiment of the present invention.

The apparatus 10 may have an outer layer 12 as shown in FIGS. 4A and 4B. The outer layer 12 may be formed of a rigid, or semi-rigid, material. The outer layer 12 may have a plurality of apertures 26. The apertures 26 may be of any size and form any ordered array 48 of apertures such that the compartments 36 of the compartment layer 56 fit through the plurality of apertures 26 in the outer layer 12 whereby compartments 36 of the compartment layer 56 protrude through the outer layer 12. Alternatively, the apertures 26 may be of any size and form any ordered array 48 of apertures such that the outer layer 12 may be positioned over the compartment layer 56. In this manner, the apertures 26 are collinear with each compartment 36 of the compartment layer 56. The outer layer 12 should not be construed as being limited to any material type. For example, the material of the outer layer 12 could be a paper or plastic material, such as a permanent, degradable or dissolvable layer.

In another aspect, the outer layer 12 may have a first half 14 and a second half 16 which may be joined or delineated, for example, by perforations 46 forming a folding point 44 between the first 14 and second half 16. The first 14 and second half 16 may have a number of apertures 26 of any size and in any ordered array 48 of apertures 26 such that when the first half 14 and second half 16 are folded together along the folding point 44 the apertures 26 of a first half 14 overlap with apertures 26 of the second half 16. The outer layer 12 is preferably constructed so the compartments 36 of the compartment layer 56 pass through the apertures of the first half 14. The outer layer 12 is also preferably constructed so the second half 16 overlaps the open ends of each compartment 36 when positioned over the sealant layer 50 so as to facilitate the localized rupture of the sealant layer 50 over an individual compartment 36.

The outer layer 12 may also have a shape such that particular parts of the outer layer 12, such as a corner or side, can be easily identified, for example specific beveled corners 28, 30. The outer layer 12 may also contain an adhesive or other binding agent or fixture on portions of its surface to aid in assembly and binding one or more layers together. The first 14 and second 16 halves of the outer layer 12, including one or more of the other layers, may optionally include a small aperture or indentation 86 for the purpose of correctly orienting and/or positioning the outer layer 12 alone or with respect to one or more of the other layers of the assembly 10 and/or a machine or device associated with the assembly 10. The present invention contemplates, in addition to outer layer 12, additional layers affixed to compartment layer 56, sealant layer 50, outer layer 12, such as an additional layer or any combination of layers to form apparatus 10.

Positionably-addressable ordered array of indicia may also be present on one or more of the individual components or layers of apparatus 10. This positionably-addressable ordered array of indicia may identify specific portions or features of a layer which may serve as an aid in assembling the apparatus 10. For example, orientation arrows 32, 34, 66 may serve to help orient one or more of the layers with respect to each other, or another additional layer or a tray 80 (shown in FIG. 7B). The indicia may aid in directing or explaining appropriate loading of contents into the apparatus 10, or individually identify compartments 36, rows, or columns, such as row indicia 40 and compartment indicia 42. The positionally-addressable ordered array of indicia may also be designed such that it correlates with indicia of other containers. For example, other lab equipment including containers, lab plates, testing trays or others may be used to facilitate easier and more efficient and accurate linking of information to the content contained within the individual compartments 36.

It is notable that, in this example, the arrangement of compartments 36, apertures 26, and indicia 40, 42 were chosen to mirror the arrangement of compartments and indicia in laboratory microtiter plates (not shown). This is advantageous because it provides for a 1-to-1 relationship between the compartments of the 96 compartment microtiter plates where test samples are held, and each uniquely identifiable compartment 36 of the present apparatus 10. This relationship provides for more ease, efficiency, and accuracy in loading apparatus 12 and in tracking its contents. Other arrangements of indicia, compartments or otherwise may also be chosen which may have a specific correlation to other containers or equipment.

The size of apparatus 10 is advantageous and has a number of inherent benefits selected to serve a number of purposes. In one aspect, the apparatus 10 is of a size such that it will fit within binders, notebooks, files, standard sized boxes for letter size paper or anywhere letter sized documents could be placed or stored. The apparatus may also have holes (not shown) which would allow the apparatus 10 to be secured within a ringed binder.

The present invention contemplates that apparatus 10 may be useful in any process where articles, such as seed, need to be stored and held separately from each other up until the point when one, several or all are ultimately dispensed. As indicated in aforementioned uses for apparatus 10, the present invention contemplates that apparatus 10 may be highly useful when its advantages are combined with a seed planter adapted for planting pre-singulated seed. Because applications and uses, and even storage, of apparatus 10 may subject apparatus 10 to forces and pressures that may distort and weaken the integrity of the structure, the present invention contemplates optional reinforcements existing in or on one or all of the layers of apparatus 10 to stabilize and allow for use in applications where additional reinforcement would be useful. For example, one or more of the layers, such as compartment layer 56, sealant layer 50, outer layer 12, or any additional layers may include structural reinforcements, which may include but are not limited to thick or rolled edging, ribbing, gussets, and/or crosslinking. Apparatus 10, with the addition of such structural reinforcements would be less apt or prone to warp, distort, twist, bend or become deformed during transport, storage, handling or use.

Methods

An assembly method is disclosed for apparatus 10. In one aspect of the assembly for apparatus 10, a compartment layer 56 with a number of compartments 36, and a sealant layer 50, adapted to close the compartments 36 of the compartment layer 56, is generally disclosed. Each compartment 36 of the compartment layer 56 is loaded with articles, for example seeds 38 or seed chips. The sealant layer 50 is attached to the compartment layer 56 such that each compartment 36 of the compartment layer 56 is sufficiently closed. The level of closure may depend on material being stored. Appropriate sealant means and methods as are known in the art may be used to create a sufficient seal or binding effect between adjacent layers. One example is peel and stick cold seal medication cards available at either Drug Packaging Inc. (901 Drug Package Lane, O'Fallon, Mo. 63366) or Total Pharmacy Supply (3400 Avenue E. East, Arlington, Tex. 76011). An outer layer 12 may also be included, which may cover one or more surfaces of compartment layer 56 and/or sealant layer 50. Indicia 40, 42 may be displayed such that each compartment 36 can be individually identified. The sealant layer 50, the compartment layer 56, and/or an outer layer 12 or some additional layer may contain adhesives, such as a heat activated adhesive, to aid in assembly and binding the apparatus 10 together. In the case of a heat activated adhesive, a step of heating the assembled apparatus 10 may be incorporated into the assembly process to activate the adhesive and securely bind the apparatus 10 together.

Figure 5C:
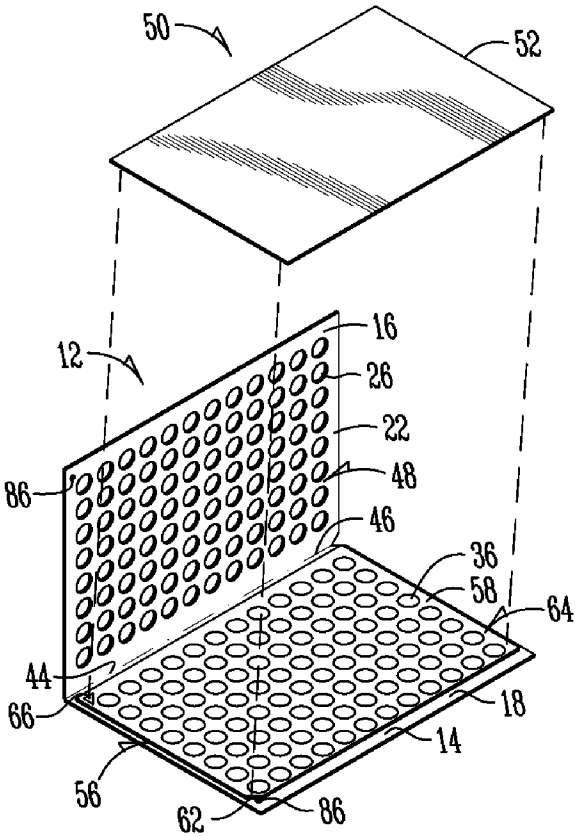
FIG. 5C is an isometric view of a third assembly view of the apparatus according to an exemplary embodiment of the present invention.
Figure 5B:
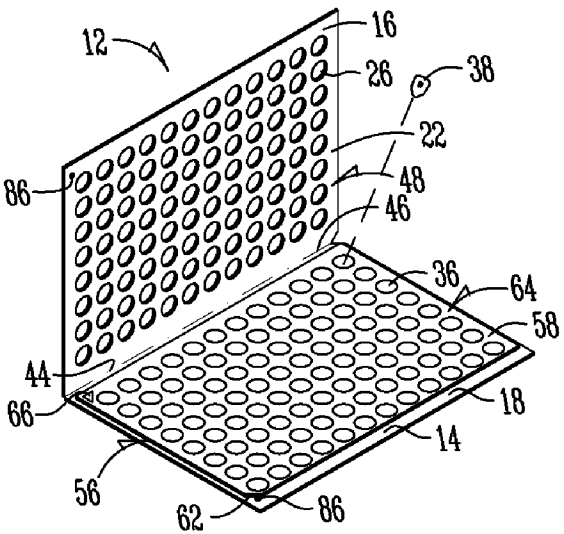
FIG. 5B is an isometric view of a second assembly view of the apparatus according to an exemplary embodiment of the present application.
Figure 5A:
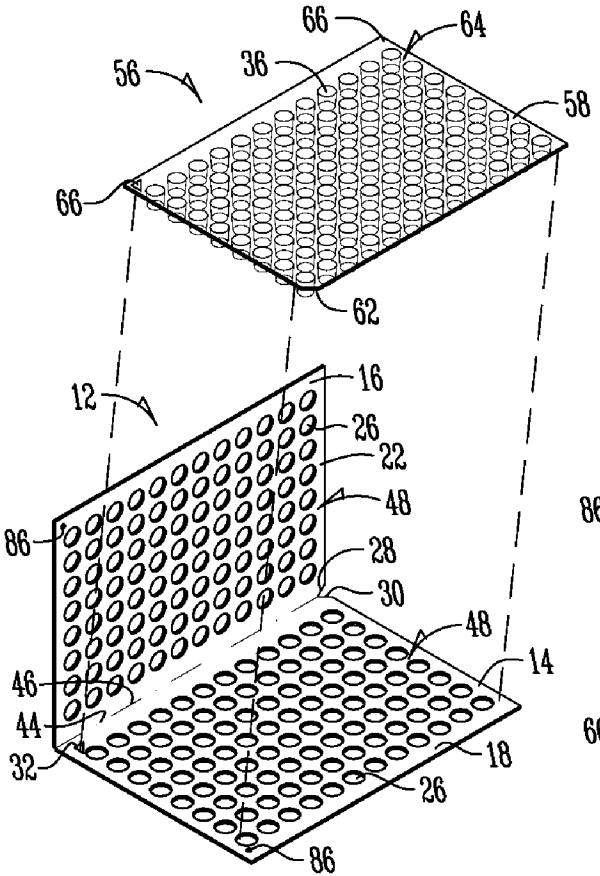
FIG. 5A is an isometric view of a first assembly view of the apparatus according to an exemplary embodiment of the present invention.
Figure 6:
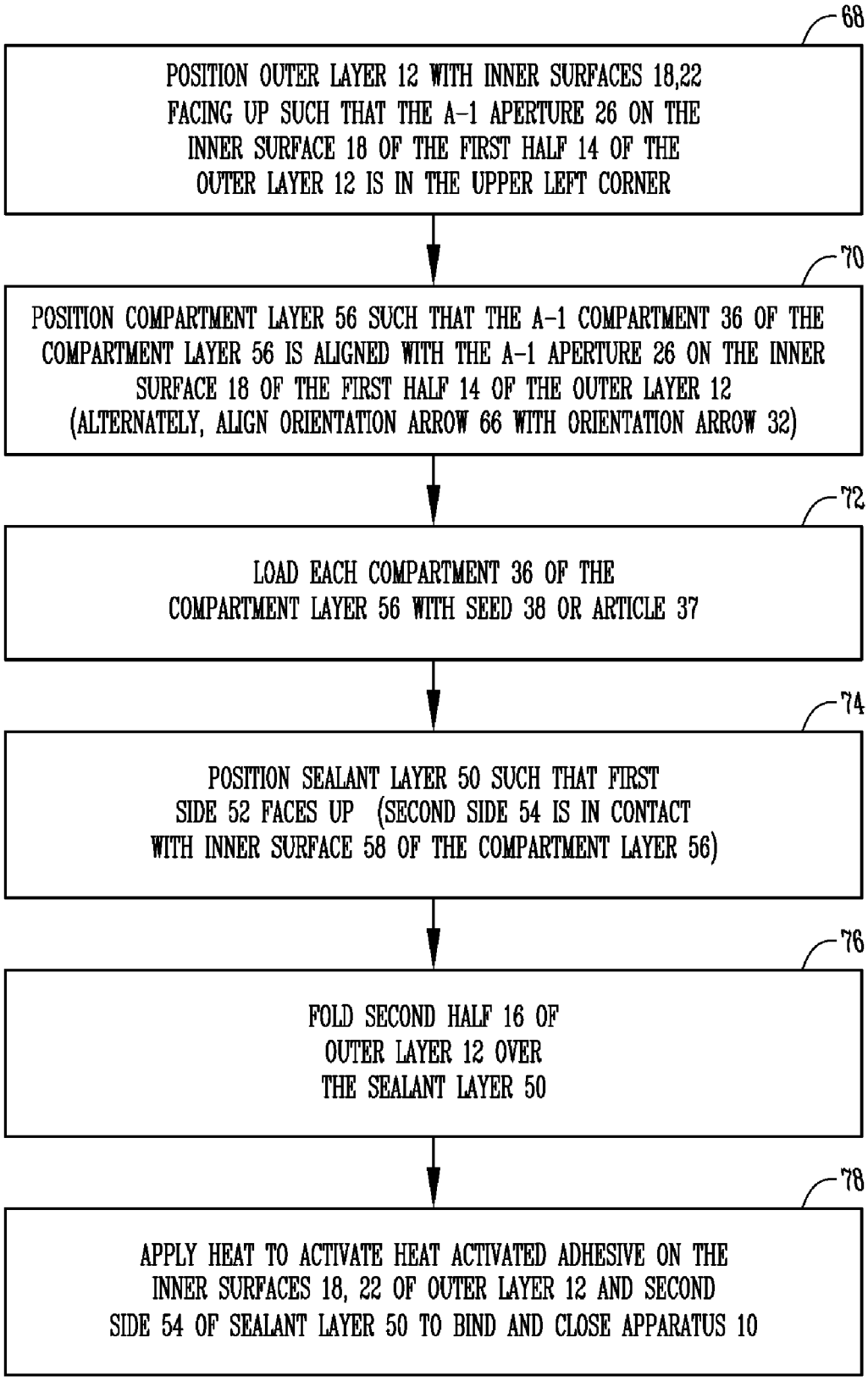
FIG. 6 is a flow chart describing one method for assembly of the apparatus according to an exemplary embodiment of the present invention.
Figure 7A:
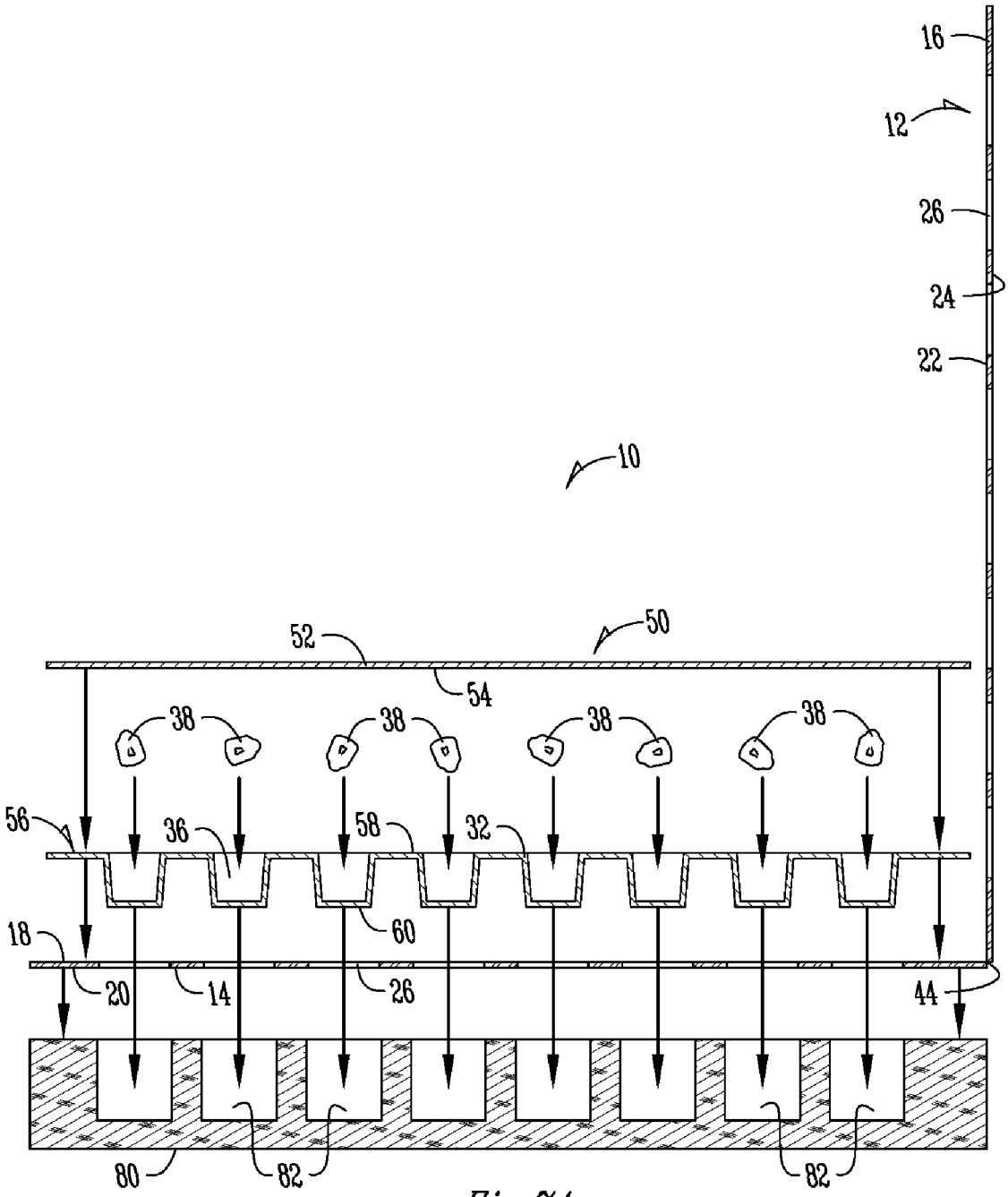
FIG. 7A is a side elevation exploded view of the apparatus according to an exemplary embodiment of the present invention.
Figure 7B:
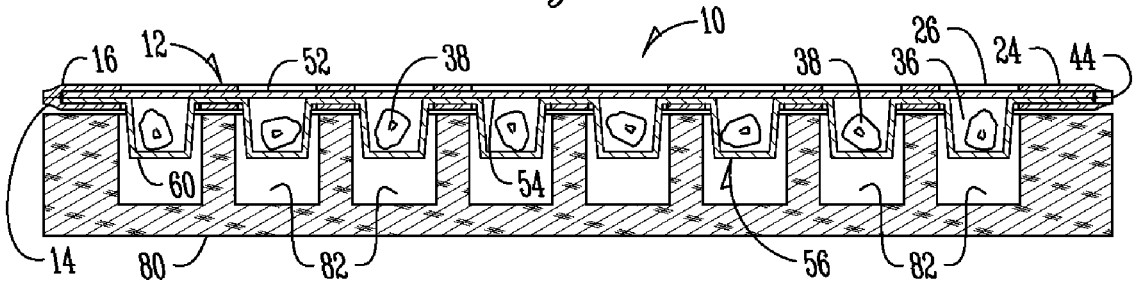
FIG. 7B is a side elevation assembly view of the apparatus according to an exemplary embodiment of the present invention.

Another, more detailed, aspect of a method for assembly of the apparatus is illustrated in FIGS. 5A-C, 6, and 7A and B. During assembly it may be helpful to incorporate a tray 80. Tray 80 may be used to support one or more of the layers of the assembly, such as the compartment layer 56. Tray 80 may also be used as a sealing tray to support one or more parts of or the entire assembly while closing up the assembly. Tray 80 could also be used as loading tray when loading the compartment layer 56. Tray 80 is designed to allow movement to be imparted to the compartment layer 56 without risk of spilling articles 37 or seeds 38 within each compartment 36. Tray 80 may also provide a flat, stable surface for working, assembling, and later sealing or binding the apparatus 10 together. In one example, the tray 80 may be a cork tray (other tray 80 materials could include, but are not limited to, plastic, metal, wood, MDF, rubber, or the like) with wells 82 having a depth exceeding the depth of each compartment 36, and oriented in an ordered array with a number and pattern matching that of the compartment layer 36. For example, tray 80 could have 96 wells in an 8-row by 12-column configuration. In this aspect of the assembly as outlined at 68, the tray 80 may be positioned over outer layer 12 such that the inner surfaces 18, 12 of the first and second halves 14, 16 are facing upward with the first half 14 positioned on the bottom with the A1 aperture in the upper, left hand corner, and the apertures of the first half 14 receiving the wells 82 of the tray 80, as illustrated by FIGS. 5A and 7A (the orientation arrow 32 marks the A1 aperture).

At 70, the compartment layer 56 is positioned through the inner surface 18 of the first half 14 of the outer layer 12 so that the orientation arrow 32 designating the A1 compartment is in the upper left corner, and the A1 compartment 36 fits into the A1 aperture 26 of the first half 14 of the outer layer 12 as illustrated by FIG. 5B. Due to the design of the tray 80, the compartment layer 56 can lay flush against the inner surface 18 of the first half 14 of the outer layer 12. At 72, the contents, for example seeds 38, to be placed in the apparatus 10 are loaded into the compartment layer 56 in each uniquely identified compartment 36.

At 74, the sealant layer 50 is applied over the top of the loaded compartments 36 of the compartment layer 56. In another example of the present invention, the sealant layer 50 may contain a heat activated adhesive layer on one surface 54. The adhesive layer side 54 of the sealant layer 50 is faced down such that the adhesive bonds to the compartment layer 56 in order to form an air tight seal. This can also be seen in FIG. 5C.

At 76, the second half 16 of the outer layer 12 is folded down such that the second half 16 is positioned over the sealant layer 50 and the compartment layer 56 with the A1 aperture of the second half 16 overlapping the A1 compartment 36 of the compartment layer 56 and the A1 aperture 26 of the first half 14. This stage can be seen in FIG. 7B. It may be helpful to pre-fold the outer layer before assembly so that two halves 14, 16 will fold easily over the folding point 44.

In this example the apparatus 10 is held together, at least partially, with a heat activated adhesive present in multiple layers. This adhesive requires applied heat to become adhesive. At 78, the assembled apparatus 10 is placed in a heat sealer on the tray 80. A Teflon sheet (not shown) may be placed on top of the second outer layer to prevent the container from sticking to the heat sealer. Once the heat is applied and the adhesive is allowed to stabilize, the apparatus 10 is assembled. FIG. 1 illustrates a fully assembled apparatus 10.

Using the positionally-addressable ordered array of indicia, seed location within each compartment 36 can be catalogued. Thus, in one exemplary method of the present invention, seed locations for each compartment 36 in the compartment layer 56 could be correlated with compartments in another container, such as for example where a seed is placed in one compartment 36 in compartment layer 56 while a portion or sample of the same seed is placed in the compartment of the other container and by using the positionally-addressable ordered array of indicia the seed and seed portion may be catalogued and correlated with each other. Thus, in the case where the seed portion is tested such test data may be used to determine which seed to retrieve from the package which may then be located using the catalogue to correlate positionally-addressable ordered array of indicia on the other container with the positionally-addressable ordered array of indicia on the seed package. Using such a method allows testing where a portion of the seed is separated and stored/tested separately to maintain a one-to-one correlation with the compartment 36 in the compartment layer 56 in which the seed is stored with the compartment in the other container where the portion of the seed is stored and tested.

Kit

The concepts of the present invention contemplate, in addition to the apparatus and methods, a kit for storing, uniquely identifying and cataloging articles, such as seed. According to one exemplary aspect of the present invention, as illustrated in FIG. 7A, the kit may include a first layer (such as compartment layer 56) having a plurality of compartments 36 adapted to open toward a first surface (such as inner surface 58) of compartment layer 56. The kit may also include a second layer (such as sealant layer 50) adapted to affix to the inner surface 58 in covering relation to the plurality of compartments 36. A positionally-addressable ordered array of indicia may be included on at least compartment layer 56 for identifying and cataloging each specific compartment 36, such as for example when loading with the seed or a portion thereof before each layer is joined together.

The kit may also include a third layer (such as an outer layer 12) having a plurality of apertures arranged to mirror the plurality of compartments 36, so as to assist in overlapping and affixing to at least compartment layer 56 or sealant layer 50. The plurality of apertures in the outer layer 12 may be arranged so each aperture is collinear with each compartment 36 to concentrate rupture forces against the sealant layer 50 whereby rupture of the sealant layer 50 is localized to a single compartment 36. The outer layer 12 may be joined with compartment layer 56 and sealant layer 50 in such a way so as to enclose compartment layer 56 and sealant layer 50. The outer layer 12 may include the positionally-addressable ordered array of indicia to identify seeds in each compartment 36 for retrieval after each layer is joined together.

In one exemplary aspect of the kit, outer layer 12 may include a first half and a second half. The first half and the second halves may be delineated by a folding point and/or delineated by perforations adapted to separate or fold the halves together in overlapping relation.

In another exemplary aspect of the kit, outer layer 12 may include: (1) a first half with an inner and an outer surface where the inner surface of the first half is affixed to the compartment layer 56; and (2) a second half with an inner and an outer surface where the inner surface of the second half is affixed to the first surface of the compartment layer 56.

One or more, or each of the layers may include a surface impregnated with an adhesive such that each layer is affixed to at least one adjacent layer by the adhesive.

In another exemplary aspect of the present invention, the kit may include a tray adapted to hold compartment layer 56 in position over outer layer 12 when loading and assembling the kit. A Teflon® layer may be included with the kit to aid in the assembly of apparatus 10.

Exemplary embodiments of the present invention has been set forth in the drawings and specification and although specific terms are employed, these are used in the generically descriptive sense only and are not used for the purposes of limitation. Changes in the formed proportion of parts as well as in the substitution of equivalence are contemplated as circumstances may suggest or are rendered expedient without departing from the spirit and scope of the invention as further defined in the following claims.

Any references in the Specification are herein incorporated by reference in their entirety.

What is claimed is:

1. An apparatus for storing, uniquely identifying and cataloging one or more articles comprising:

a first layer having a plurality of compartments adapted to open toward a first surface of the first layer;

a second layer adapted to affix to the first surface in covering relation to the plurality of compartments; and a positionally-addressable ordered array of indicia on at least one of the layers to identify and catalogue each article with respect to each specific compartment, further comprising a material alteration that identifies a specific corner of the first layer, configured to aid in a desired orientation of the apparatus.

2. The apparatus of claim 1 further comprising a third layer having a plurality of apertures arranged to mirror the plurality of compartments, the third layer adapted to overlap and affix to at least the first or the second layer.

3. The apparatus of claim 2 wherein the third layer further comprises a first half and a second half;

a) delineated by a folding point; or b) delineated by perforations adapted to hold and fold the halves together and/or separate the halves.

4. The apparatus of claim 1 further comprising a third layer having:

a) a first half with an inner and an outer surface, wherein the inner surface is affixed to the first layer; and/or b) a second half with an inner and an outer surface, wherein the inner surface is affixed to the first surface of the first layer.

5. The apparatus of claim 1 further comprising a third layer adapted to enclose the first and the second layers, wherein the third layer has the positionally-addressable ordered array of indicia to identify articles in each compartment for retrieval.

6. An apparatus for storing, uniquely identifying and cataloging one or more articles comprising:

a first layer having a plurality of compartments adapted to open toward a first surface of the first layer;

a second layer adapted to affix to the first surface in covering relation to the plurality of compartments; and a positionally-addressable ordered array of indicia on at least one of the layers to identify and catalogue each article with respect to each specific compartment, further comprising orientation indicia configured to aid in a desired orientation of the apparatus.

7. The apparatus of claim 6 further comprising a third layer having a plurality of apertures arranged to mirror the plurality of compartments, the third layer adapted to overlap and affix to at least the first or the second layer.

8. The apparatus of claim 7 wherein the third layer further comprises a first half and a second half;

a) delineated by a folding point; or b) delineated by perforations adapted to hold and fold the halves together and/or separate the halves.

9. The apparatus of claim 6 further comprising a third layer having:

a) a first half with an inner and an outer surface, wherein the inner surface is affixed to the first layer; and/or b) a second half with an inner and an outer surface, wherein the inner surface is affixed to the first surface of the first layer.

10. The apparatus of claim 6 further comprising a third layer adapted to enclose the first and the second layers, wherein the third layer has the positionally-addressable ordered array of indicia to identify articles in each compartment for retrieval.

* * * * *